US010237637B2

(12) United States Patent
Yan et al.

(10) Patent No.: US 10,237,637 B2
(45) Date of Patent: Mar. 19, 2019

(54) CONNECTED SPEAKER DEVICE COMPRISING LATCH SYSTEM

(71) Applicant: NINGBO TONWEL AUDIO EQUIPMENTS CO., LTD., Ningbo (CN)

(72) Inventors: Jun Yan, Ningbo (CN); Yixian Xu, Ningbo (CN); Yi Zhang, Ningbo (CN); Zhiqin Wang, Ningbo (CN); Bingyao Yan, Ningbo (CN)

(73) Assignee: NINGBO TONWEL AUDIO EQUIPMENTS CO., LTD., Ningbo (CN)

( * ) Notice: Subject to any disclaimer, the term of this patent is extended or adjusted under 35 U.S.C. 154(b) by 0 days.

(21) Appl. No.: 15/853,735

(22) Filed: Dec. 23, 2017

(65) Prior Publication Data

US 2018/0288509 A1 Oct. 4, 2018

(30) Foreign Application Priority Data

Mar. 29, 2017 (CN) ..... 2017 1 0195658
May 10, 2017 (CN) ..... 2017 2 0514020 U

(51) Int. Cl.

| | |
|---|---|
| ***H04R 1/02*** | (2006.01) |
| ***H04R 1/40*** | (2006.01) |
| ***H04R 3/00*** | (2006.01) |
| *H04R 27/00* | (2006.01) |

(52) U.S. Cl.
CPC ..... *H04R 1/025* (2013.01); *H04R 1/026* (2013.01); *H04R 1/403* (2013.01); *H04R 3/00* (2013.01); *H04R 27/00* (2013.01); *H04R 2201/403* (2013.01)

(58) Field of Classification Search
CPC ..... H04R 1/02; H04R 3/12; H04R 1/1041; H04R 5/02; H04R 2201/403
USPC ..... 381/182, 374, 337, 345, 351
See application file for complete search history.

(56) References Cited

U.S. PATENT DOCUMENTS 6,176,346 B1 * 1/2001 Wiener ..... H04R 1/02 181/199
2007/0181332 A1 * 8/2007 Fraley ..... B60R 16/0222 174/72 A

* cited by examiner

*Primary Examiner* — Alexander Jamal
(74) *Attorney, Agent, or Firm* — W&K IP

(57) ABSTRACT

Embodiments of the disclosure disclose a connected speaker device having a first speaker, a first plate mounted on the first speaker, a second speaker, and a second plate which is mounted on the first speaker and connected to at least a part of the first plate. A distance between the first, speaker and the second speaker is equal to a sum of thicknesses of the first plate and the second plate. The disclosed connected speaker device effectively reduces the distance between adjacent speakers and ensures reliability of the connection between the speakers at the same time.

8 Claims, 11 Drawing Sheets

CONNECTED SPEAKER DEVICE COMPRISING LATCH SYSTEM

CROSS-REFERENCE TO RELATED APPLICATIONS

This application claims priority to Chinese Patent Application No. 201710195658.6 with a filing date of Mar. 29, 2017 and No. 201720514020.X with a filing date of May 10, 2017. The content of the aforementioned applications, including any intervening amendments thereto, are incorporated herein by reference.

TECHNICAL FIELD

The present disclosure relates to the field of speakers and more particularly, to a connected speaker device comprising a latch system.

BACKGROUND OF THE PRESENT INVENTION

Nowadays linear array speakers are becoming frequently used in activities such as outdoor performances and sporting events. A linear array speaker typically comprises a series of speakers vertically mounted to each other in a linear configuration. Sound effects provided by the linear array speaker as configured may propagate further and cover a wider ground, such that users in different locations would share a favorable aural experience. A sound signal of a spherical wave corresponding to a single speaker has a wavefront radiation surface which has a size proportional to a square of distance. Therefore, the sound intensity for an audience decreases by 6 dB as the distance is doubled. On the other hand, a sound signal of a cylindrical wave corresponding to an ideal linear array speaker has a wavefront radiation surface which has a size proportional to the distance. The sound intensity for an audience decreases by only 3 dB as the distance is doubled. Obviously the linear array speaker is more suitable for long distance sound propagation.

In actual implementations, a linear array speaker achieved by connecting a plurality of single speakers together. When connecting multiple speakers together, the connecting structure between a speaker and another speaker connected thereto would define the distance between the two adjacent speakers. In an ideal situation, the cylindrical wave is achieved when the distance between the point sound sources of adjacent speakers limits to zero. Since it is apparent that a distance between the point sound sources of adjacent speakers can not reach zero, the size of the connecting structures can only be reduced as much as possible. A speaker available on the market usually comprises multiple speakers which resemble point sound sources. It is easier to reduce the distance between the point sound sources within the speaker, but reduction of the distance between the point sound sources located in adjacent speakers would be limited by the connecting structures between the speakers. Connecting structures in prior arts usually comprise various components including wiring structures, fixing structures, and support structures, which are relatively large in size. The minimal distance between point sound sources, in adjacent speakers of a linear array speaker may reach 3~5 centimeters or even larger. A relatively large distance between point sound sources would cause the sound waveform emitted by the linear array speaker to deviate from the cylindrical wave. The sound waveform would become more similar to the spherical wave as the distance increases. Therefore, it is necessary to provide a thinner connecting structure which reduces the minimal distance between point sound sources while maintaining reliability, Further, fixation of the two speakers is typically performed with screws in existing technologies. For example, a plurality of screw holes can be arranged on the two speakers respectively, and connection of the two speakers is accomplished by a connection with screws. Such an approach of connection renders assembly or disassembly of two speakers less convenient. The screws must be unscrewed each time the speakers are assembled or disassembled, and a large amount of work is necessary. Also, the connection of screws to the screw holes is prone to loosening after multiple times of assembly or disassembly. That is to say, the connection between two speakers may not be firm enough after multiple times of assembly or disassembly.

SUMMARY OF PRESENT INVENTION

One objective of the present invention is to solve at least some problems of the prior arts and provide a connected speaker device which ensures reliability of the connection between the speakers and reduces the minimal distance between the speakers. The connected speaker device comprises a first speaker, a first plate mounted on the first speaker, a second speaker, and a second plate which is mounted on the first speaker and connected to at least a part of the first plate. The first plate comprises a first surrounding part arranged on a surface mounted onto the first speaker. The second plate comprises a second surrounding part arranged on a surface mounted onto the second speaker. The first plate is screwed to the first speaker through a first plurality of screw holes arranged outside the first surrounding part. The second plate is screwed to the second speaker through a second plurality of screw holes arranged outside the second surrounding part, and a distance between the first speaker and the second speaker is equal to a sum of thicknesses of the first plate and the second plate.

The connected speaker device according to the embodiments allows the two adjacent speakers to be handily engaged and disengaged. The distance between the two speakers is equal to a sum of thicknesses of the first plate and the second plate by mounting the speaker in screws holes outside edge of the surround part. It is thus possible to reduce the distance between the two speakers by reducing the thickness of the first and second plates. When multiple speakers are connected to each other using such a connecting structure, the produced linear array speaker can generate a sound waveform closer to the cylindrical wave.

In some embodiments, a raised part having two conductive pads is arranged on a first contacting surface where the first plate contacts the second plate, and a recessed part having two conductive heads corresponding to the two conductive pads is arranged on a second contacting surface where the second plate contacts the first plate.

In some embodiments, the conductive pads are electrically connected to a plurality of first contacting components arranged within an area surrounded by the first surrounding part, and the conductive heads are electrically connected to a plurality of second contacting components arranged within an area surrounded by the second surrounding part, and an elastic component is arranged between the conductive heads and the second contacting components to keep the conductive heads in close contact with the conductive pads.

In some embodiments, a locking components rotatably connected to one end of the first plate, one or more holders are connected to the other end of the first plate, a locking notch to connect to the locking component is arranged on one end of the second plate, and a first aperture to insert the one or more holders is arranged on the other end of the second plate.

In some embodiments, a rotating shaft is arranged on an upper end of the locking component, a torsion plate is screwed to an upper end of the rotating shaft, the first plate is located between the locking component and the torsion plate, the upper end of the rotating shaft comprises screw holes, and screws are connected to the screw holes on the rotating shaft through the torsion plate.

In some embodiments, the upper end of the rotating shaft further comprises two limiting recesses symmetrically distributed thereon, two bumps are arranged on a lower end of torsion plate which are in close contact with the two limiting recesses, a first bayonet is arranged on the torsion plate, a second bayonet is arranged on the first plate, a torsion spring is mounted around the rotating shaft, one end of the torsion spring is connected to the first bayonet, the other end of the torsion spring is connected to the second bayonet, and the second bayonet is uniformly distributed on the upper surface of the first plate.

In some embodiments, the locking component comprises a disk part, an edge of the locking component comprises a first slope, and a cross-section of the locking notch comprises a second slope to match with the first slope on the locking component.

In some embodiments, the locking component comprises a lever arranged in a diametrical direction, and the second plate comprises an opening to receive the lever.

In some embodiments, a cylindrical pin is slidably connected to the first plate, a blind hole for the cylindrical pin to slide within is arranged on the first plate, a compressed spring is arranged between the cylindrical pin and the blind hole, a second aperture is arranged on the locking component, and the cylindrical pin and the second aperture are in close contact with each other.

In some embodiments, each of the first plate and the second plate has a thickness of 7 millimeters.

Embodiments of the present disclosure provide a connected speaker device which effectively reduces the distance between adjacent speakers and ensures reliability of the connection between the speakers. Multiple speakers combined according to the embodiments of the present disclosure to form a linear array speaker can provide a waveform closer to a cylindrical wave and achieve more distant sound propagation. Further, physical and electrical connections between adjacent speakers can be implemented using the connecting structures of the disclosed embodiments without aid of additional tools. It is easier to assemble and disassemble the connected speaker device.

DESCRIPTION OF THE DRAWINGS

The present invention is illustrated by way of example and not limitation in the figures of the accompanying drawings, in which like references indicate similar elements, and in which.

DETAILED DESCRIPTION OF PREFERRED EMBODIMENTS

Figure 1:
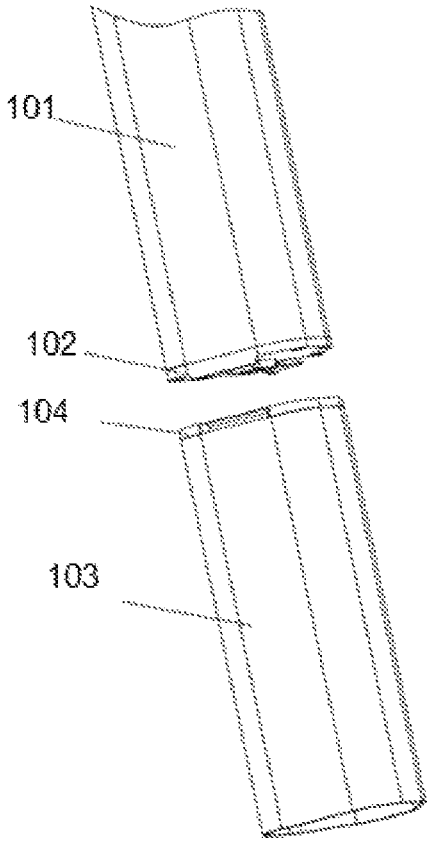
FIG. 1 is a schematic diagram of a part of a connected speaker according to some embodiments.
Figure 2:
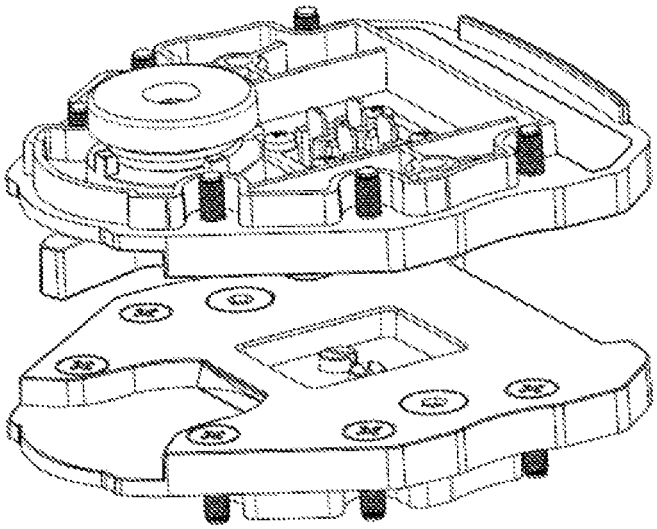
FIG. 2 is a schematic diagram of a connecting structure of a connected speaker according to some embodiments.
Figure 3:
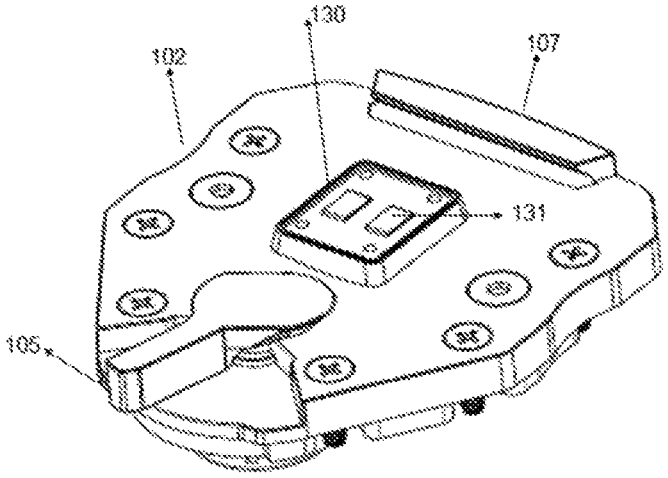
FIG. 3 is a top view of a first plate of a connecting structure of a connected speaker according to some embodiments.

Various aspects of the illustrative embodiments will be described using terms used by those commonly skilled in the art to convey the substance of their work to other. However, it be apparent to the skilled in the art that alternate embodiments may be practices with only some of the described aspects. For purposes of explanation, specific number, materials, and configurations are set forth in order to provide a thorough understanding of the illustrative embodiments. However, it will be apparent to one skilled in the art that alternate embodiments may be practices without the specific details. In other instances, well-known features are omitted or simplified in order not to obscure the illustrative embodiments.

Although the terms first, second, third right, upper, lower, etc. may be used herein to describe venous elements, these elements should not be limited by these terms. These terms are only used to distinguish one element from another. Terms such as "first," "second," and other numerical terms when used herein do not imply a sequence or order unless clearly indicated by the context. Thus, a first element could be termed a second element, and a left component could be termed a right component without departing from the teachings of the example embodiments. In addition, the term "and/or" may mean "and", "or", "exclusive-or", "one", "some, but not all", "neither", or "both", although the scope of the claimed subject matter is not limited in this respect. In the following description and/or claims, the terms "comprise" and "include", along with their derivative, may be used and are intended as synonyms for each other. The terms used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Furthermore, in the following description and/or claims, the terms coupled and/or connected, along with their derivatives, may be used. In particular embodiments, connected may be used to indicate that two or more elements are in direct physical and/or electrical contact with each other. Coupled may mean that two or more elements are in direct physical and/or electrical contact with each other. Coupled may mean that two or more elements are in direct physical and/or electrical contact. However, coupled may also mean that two or more elements may not be in direct contact with each other, but yet may still cooperate and/or interact with each other. For example, "coupled" may mean that two or more elements do not contact each other but are indirectly joined together via another element or intermediate elements.

Figure 4:
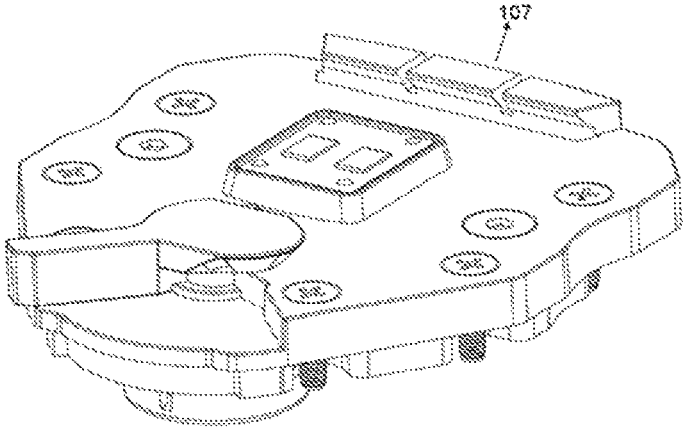
FIG. 4 is a top view of a first plate of a connecting structure of a connected speaker according to other embodiments.
Figure 5:
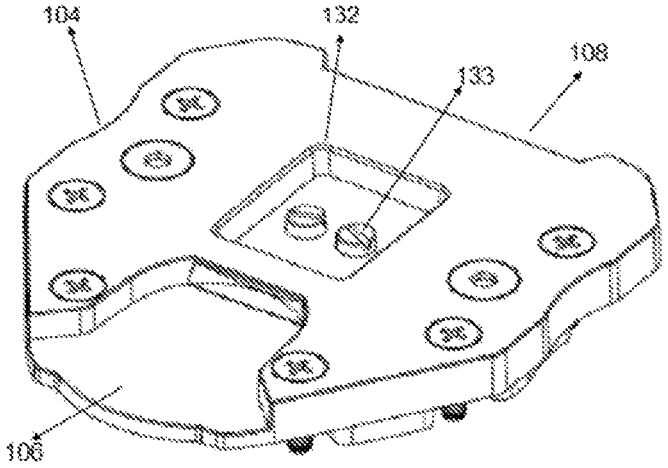
FIG. 5 is a top view of a second plate of a connecting structure of a connected speaker according to some embodiments.
Figure 6:
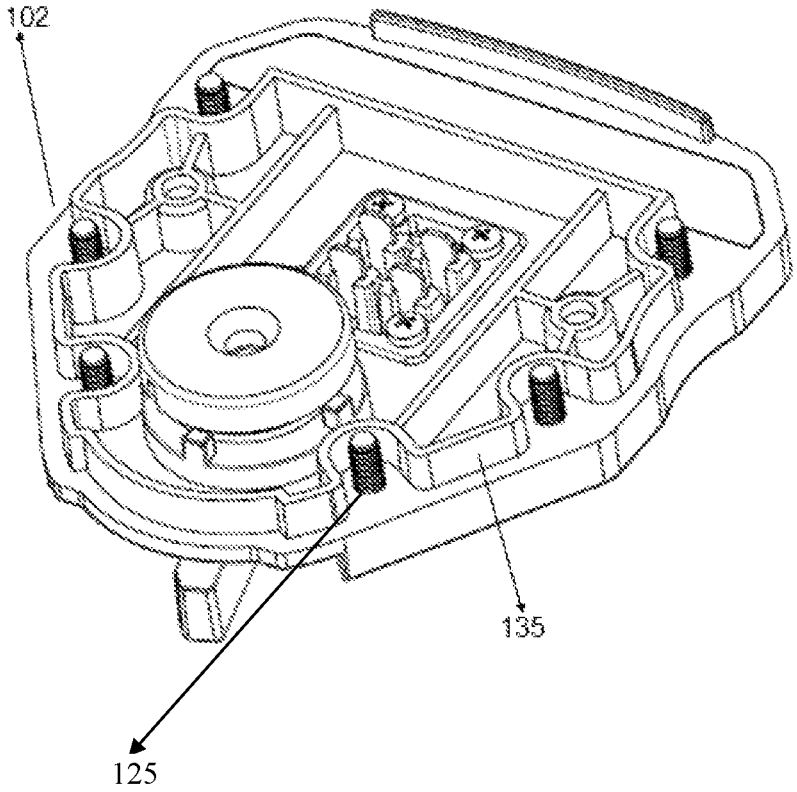
FIG. 6 is a bottom view of a first plate of a connecting structure of a connected speaker according to some embodiments.
Figure 7:
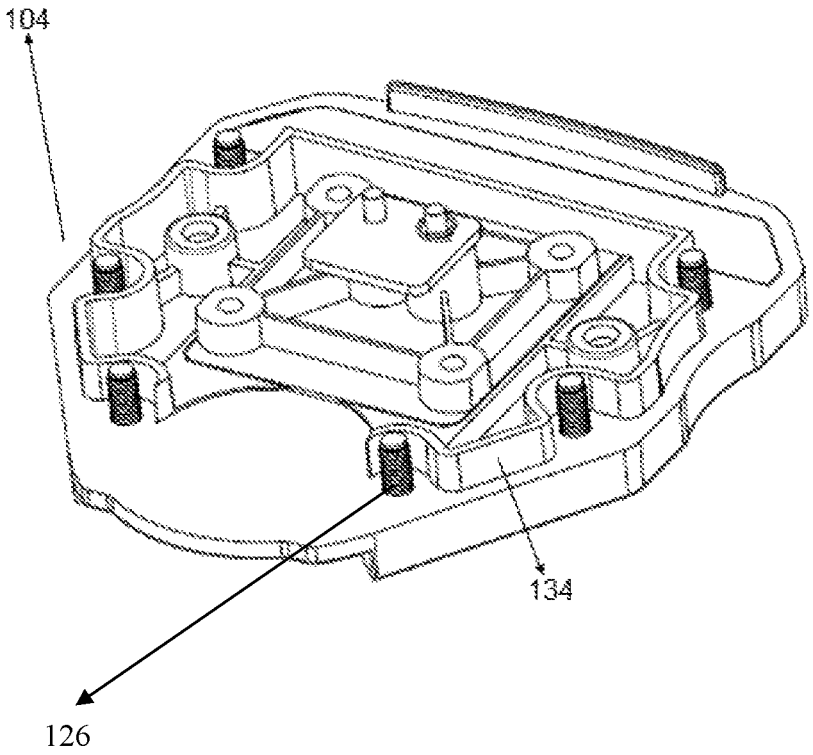
FIG. 7 is a bottom view of a second plate of a connecting structure of a connected speaker according to some embodiments.
Figure 8:
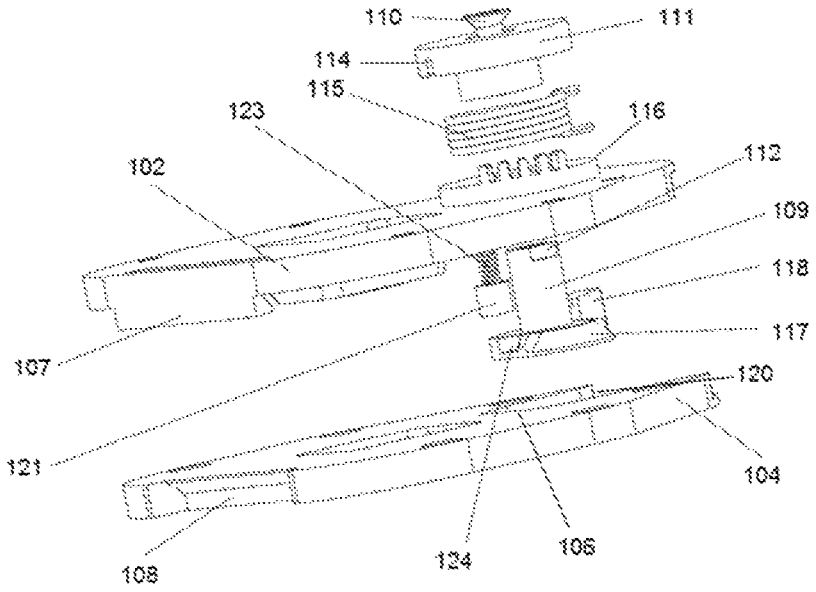
FIG. 8 is an explosive view of a connecting structure of a connected speaker according to some embodiments.
Figure 9:
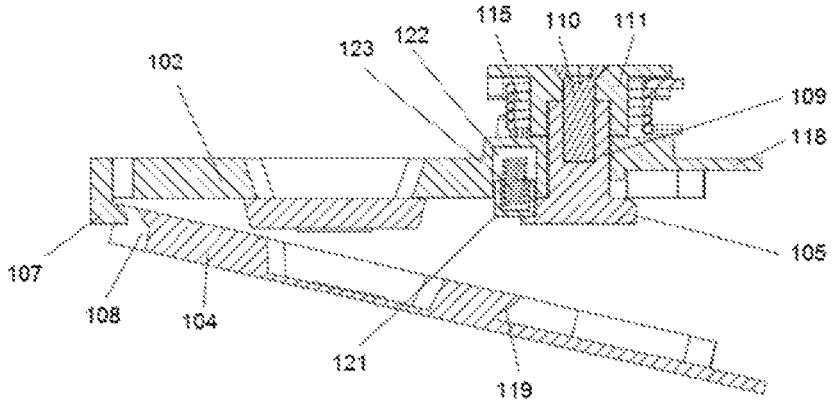
FIG. 9 is a cross-sectional view of a connecting structure of a connected speaker according to some embodiments.
Figure 10:
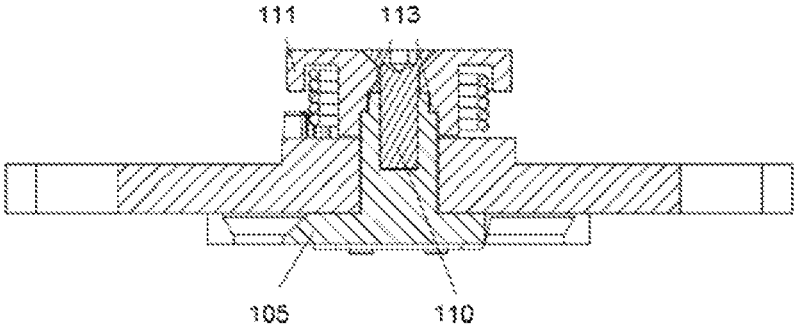
FIG. 10 is a cross-sectional view of a part of a first plate in a connecting structure of a connected speaker according to some embodiments.
Figure 11:
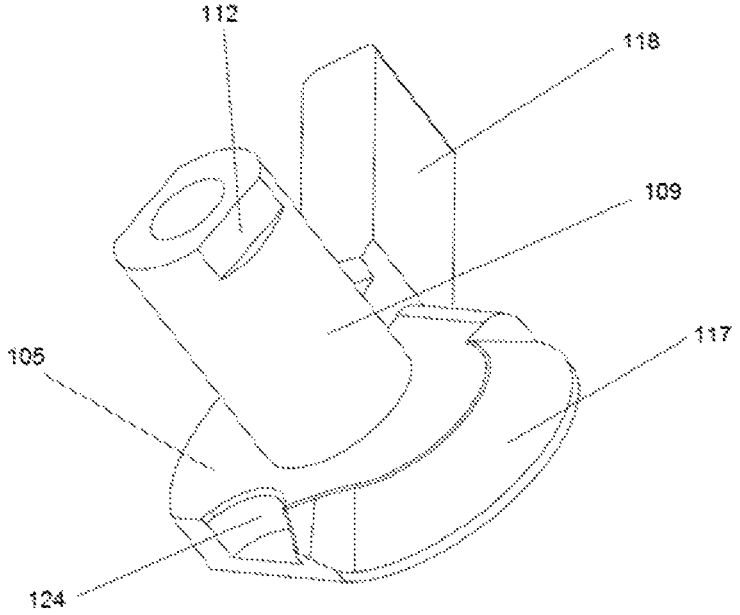
FIG. 11 is a schematic diagram of a locking component of a connected speaker according to some embodiments.

FIGS. 1-4 show part of the linear connected speaker device. A plurality of single speakers may be included in the linear connected speaker device. Every two adjacent speakers are connected by a connecting structure. As shown in the figures, the connecting structures comprises a first plate 102 connected to the first speaker 101 and a second plate 104 connected to the second speaker 103. One end of the first plate 102 is connected to the second plate 104. A locking component 105 is rotatably connected to the other end of the first plate 102. A locking notch 106 to engage with or disengage from the locking component 105 is provided on the second plate 104. Holders 107 are provided on the first plate 102, and a first aperture 108 to insert the holders 107 are provided on the second plate 104. As shown in FIG. 4, there may be one or more holders 107. Each holder 107 is designed to have a protruding end part with a relatively larger cross-section. The end part can be inserted into the first aperture 106 such that the first plate 102 and the second plate 104 are connected to each other. The thickness H of each of the first plate 102 and the second plate 104 is below 15 millimeters. The first plate 102 and the second plate 104 may have a same thickness to facilitate manufacture. For example, the thickness H of each of the first plate 102 and the second plate 104 can be 7-7.5 millimeters.

FIGS. 2-7 show the structures of the first plate 102 and the second plate 104 in greater details. The first plate 102 has a raised part 130 on a contacting surface of the first plate 102 where the first plate 102 contacts the second plate 104. Two conductive pads 131 are arranged on the raised part 130. A recessed part 132 to abut the raised part 130 is arranged on a contacting surface of the second plate 104 where the second plate 104 contacts the first plate 102. Two conductive heads 133 corresponding to the two conductive pads 131 are arranged within the recessed part 132. The conductive heads 133 are in contact with the conductive pads 131, and as a result the first speaker 101 and the second speaker 103 can be electrically coupled to each other. In prior arts, external conducting wires are typically used to connect the first speaker 101 to the second speaker 103. The conducting wires can be arranged inside the speaker by deploying the conductive heads 133 and the conductive pads 131 on the contacting surface of the connecting structures. It is no longer required to connect conducting wires when assembling the connected speaker, since an electrical connection is formed on connecting the first plate 102 to the second plate 104. The process of the assembly is thus more convenient. It is also no longer necessary to disconnect the electrical connect when disassembling the connected speaker. The disconnection can be achieved by physical separating the adjacent speaker. An electrical connection formed by such an approach can be used to provide power supply and transmit data signals and/or control signals between different speakers.

The first plate 102 comprises a protruding first surrounding part 135 arranged on a surface mounted onto the first speaker 101. The second plate 104 comprises a protruding second surrounding part 134 arranged on a surface mounted onto the second speaker 103. The first plate 102 is screwed to the first speaker 101 through a first plurality of screw holes 125 arranged outside the first surrounding part 135. The second plate 104 is screwed to the second speaker 103 through a second plurality of screw holes 126 arranged outside the second surrounding part 134. The protruding first surrounding part 135 is provided on the other surface of the first plate 102. An area surrounded by the first surrounding part 135 comprises a part of the first plate 102 on that surface. Similarly, the protruding second surrounding part 134 is on the surface of the second plate 104 which is opposed to the contacting surface. An area surrounded by the second surrounding part 134 comprises a part of the second plate 104 on that surface. The areas surrounded by the first surrounding part 135 and the second surrounding part 134 comprise contacting components which are electrically connected to the conductive pads 131 and the conductive heads 133, respectively. The contacting components are respectively located within the first speaker 101 and the second speaker 103 after being mounted. An elastic component, e.g., a spring, is arranged between the conductive heads 133 and the contacting components connected thereto. The elastic component provides an outward elastic force for conductive heads 133 such that the conductive heads 133 are maintained in close contact with the conductive pads 131. Poor conductivity due to a loose contact during usage of the speaker can be avoided. Therefore, the raised part 130, the locking component 105 and the holders 107 are respectively inserted into the recessed part 132, the locking notch 106 and the first aperture 108 when the first plate 102 is connected to the second plate 104. The distance between the first speaker 102 and the second speaker 104 is equal to a sum of thicknesses of the first plate 102 and the second plate 104. In prior arts, the first speaker 101 and the second speaker 103 are typically connected by screws. This approach is time-consuming since multiple screws must be unscrewed before the first speaker 101 and the second speaker 103 can be connected or disconnected. The screws may come loose after several times of assemblies and disassemblies, causing an unstable connection between the first speaker 101 and the second speaker 103. Connecting the first speaker 101 and the second speaker 103 with the raised part 130, the locking component 105, the holders 107, the recessed part 132, the locking notch 106 and the first aperture 108 would facilitate the mounting process. The speakers can be separated from each other during transportation and the mounting process can be completed swiftly during usage.

The connecting structures discussed above help to reduce the distance between speakers below 30 millimeters while ensuring the reliability of the connection between the speakers. A plurality of screw holes are arranged outside the edges of the first surrounding part 135 and the second surrounding part 134. The first speaker 101 and the second speaker 103 are screwed to the plurality of screw holes by screws and nuts. The structures surrounded by the first surrounding part 135 and the second surrounding part 134 are thus received within the bodies of the first speaker 101 and the second speaker 103. Because the distance between two adjacent sound sources of the multiple sound sources within the first speaker 101 and the second speaker 103 is typically below 30 millimeters, the distance between the bottommost sound source in the first speaker 101 and the topmost sound source in the second speaker 103 should be equal to the distance between adjacent sound sources within a speaker. A distance D exists between the bottommost sound source in the first speaker 101 and the first plate 102. Similarly, a distance d exists between the topmost sound source in the second speaker 103 and the second plate 104. Therefore, the distance between the bottommost sound source in the first speaker 101 and the topmost sound source in the second speaker 103 is substantially equal to D+d+2H. The sum of D+d+2H can be reduced below 30 millimeters by controlling the thickness H of the first plate 102 and the second plate 104.

In optional embodiments as shown in FIGS. 8-11, a rotting shaft 109 is arranged on an upper end of the locking component 105. A torsion plate 111 is screwed to an upper end of the rotating shaft 109 by the screws 110. The first plate 102 is located between the locking component 105 and the torsion plate 111. The upper end of the rotating shaft 109 comprises screw holes. The screws 110 are connected to the screw holes on the rotating shaft 109 through the torsion plate 111. The upper end of the rotating shaft 109 further comprises two limiting recesses 112 which are symmetrically distributed on that upper end. Two bumps 113 are arranged on a lower end of torsion plate 111. The two bumps 113 are in close contact with the two limiting recesses 112. A first bayonet 114 is arranged on the torsion plate 111. A second bayonet 116 is arranged on the first plate 102. A torsion spring 115 is mounted around the rotating shaft 109. One end of the torsion spring 115 is connected to the first bayonet 114, and the other end of the torsion spring 115 is connected to the second bayonet 116. The locking component 105 comprises a disk part. An edge of the locking component 105 comprises a first slope 117. The shape of the first slope 117 is am arc distributed around the rotating shaft 109. A cross-section of the locking notch 106 comprises a second slope 119 to match with the first slope 117 on the locking component 105. The locking component 105 can be designed as a cam with a handle to adjust rotation of the cam. The cam can be rotated by turning the handle, and the torsion plate 111 also rotates with the cam.

The locking component 105 comprises a lever 118 arranged in a diametrical direction, and the second plate 104 comprises an opening 120 to receive the lever 118. The lever 118 rotates about the rotating shaft 109 within the opening 120. A cylindrical pin 121 is slidably connected to the first plate 102. A blind hole 122 for the cylindrical pin 121 to slide within is arranged on the first plate 102. A compressed spring 123 is arranged between the cylindrical pin 121 and the blind hole 122. A second aperture 124 is arranged on the locking component 105. The cylindrical pin 121 is configured to engage with or disengage from the second aperture 124.

When mounting the first speaker 101 onto the second speaker 103, the first plate 102 is firstly fixed to the first speaker 101, and then the second plate 104 is mounted onto the second speaker 103. The connection between the plates and the speakers can be performed by screws during actual installation. Once the installation is completed there is no more need to perform more disassemblies to connect the speakers with each other. After the installation, the first plate 102 forms a single body with the first speaker 101, and the second plate 104 forms a single body with the second speaker 103.

When connecting the first plate 102 and the second plate 104, the holders 107 on the first plate 102 are firstly connected to the first aperture 108 of the second plate 104. Subsequently, the first plate 102 can be rotated around the first aperture 108. During the rotation of the first plate 102, the cylindrical pin 121 on the lower surface of the first plate 102 would contact with the contacting surface of the second plate 104. As the first plate 102 becomes nearer to the second plate 104, the cylindrical pin 121 would be pushed upwards inside the blind hole 122 until the cylindrical pin 121 is detached from the second aperture 124 of the locking, component 105. In this way, the locking component 105 can be rotated around the rotating shaft 109 by the torsion of the torsion spring 115.

During rotation of the locking component 105, the first slope 117 on the locking component 105 would be abutted against the second slope 119 on the locking notch 106. Once a gap is formed between the first slope 117 and the second slope 119, the locking component 105 will rotate due to torsion of the torsion spring 115 to ensure the first slope 117 and the second slope 119 maintain in close contact without detaching from each other. The connection of the first speaker 101 with the second speaker 103 is completed by abutting the first plate 102 against the second plate 104.

When it is required to detach the first plate 102 from the second plate 104, the user needs only to rotate the lever 118 to cause the locking component 105 to rotate about the rotating shaft 109. During the rotation of the locking component 105, the cylindrical pin 121 will slide under a force induced by the compressed spring 123 until the cylindrical pin 121 falls into the second aperture 124 if the second aperture 124 on the locking component 105 happens to be directly below the cylindrical pin 121. After that, the locking component 105 no longer rotates about the rotating shaft 109, and the detachment of the locking component 105 from the locking notch 106 is completed. The operator can easily remove the first plate 102 from the second plate 104 manually without the assistance of additional tools.

Although certain embodiments have been illustrated and described herein for purposes of description, a wide variety of alternate and/or equivalent embodiments or implementations to achieve the same purposes may be substituted for the embodiments shown and described without departing from the scope of the present disclosure. This application is intended to cover any adaptations or variations of the embodiments discussed herein. Therefore, it is manifestly intended that embodiments described herein be limited only by the claims and the equivalents thereof. Particular terms used herein when describing certain feature or aspects should not be taken to imply the terms are redefined to be restricted to any specific feature or aspects with which they are associated. In general, the terms used in the claims should not be construed to limit the invention to specific examples disclosed in the specification, unless the specification explicitly defines such terms. Accordingly, the actual scope of the invention encompasses not only the disclosed examples, but also all equivalent ways of practicing or implementing the invention under the claims.

We claim:

1. A connected speaker device, comprising:

a first speaker;

a first plate mounted on the first speaker;

a second speaker; and a second plate which is mounted on the first speaker and connected to at least a part of the first plate, wherein the first plate comprises a first surrounding part arranged on a surface mounted onto the first speaker, wherein the second plate comprises a second surrounding part arranged on a surface mounted onto the second speaker, wherein the first plate is screwed to the first speaker through a first plurality of screw holes arranged outside the first surrounding part, wherein the second plate is screwed to the second speaker through a second plurality of screw holes arranged outside the second surrounding part, wherein a distance between the first speaker and the second speaker is equal to a sum of thicknesses of the first plate and the second plate, wherein a raised part having two conductive pads is arranged on a first contacting surface where the first plate contacts the second plate, and a recessed part having two conductive heads corresponding to the two conductive pads is arranged on a second contacting surface where the second plate contacts the first plate, and wherein the conductive pads are electrically connected to a plurality of first contacting components arranged within an area surrounded by the first surrounding part, and the conductive heads are electrically connected to a plurality of second contacting components arranged within an area surrounded by the second surrounding part, and wherein an elastic component is arranged between the conductive heads and the second contacting components to keep the conductive heads in close contact with the conductive pads.

2. The connected speaker device of claim 1, wherein a locking component is rotatably connected to one end of the first plate, one or more holders are connected to the other end of the first plate, a locking notch to connect to the locking component is arranged on one end of the second plate, and a first aperture to insert the one or more holders is arranged on the other end of the second plate.

3. The connected speaker device of claim 2, wherein a rotating shaft is arranged on an upper end of the locking component, a torsion plate is screwed to an upper end of the rotating shaft, the first plate is located between the locking component and the torsion plate, the upper end of the rotating shaft comprises screw holes, and screws are connected to the screw holes on the rotating shaft through the torsion plate.

4. The connected speaker device of claim 3, wherein the upper end of the rotating shaft further comprises two limiting recesses symmetrically distributed thereon, two bumps are arranged on a lower end of torsion plate which are in close contact with the two limiting recesses, a first bayonet is arranged on the torsion plate, a second bayonet is arranged on the first plate, a torsion spring is mounted around the rotating shaft, one end of the torsion spring is connected to the first bayonet, the other end of the torsion spring is connected to the second bayonet, and the second bayonet is uniformly distributed on the upper surface of the first plate.

5. The connected speaker device of claim 4, wherein the locking component comprises a disk part, an edge of the locking component comprises a first slope, and a cross-section of the locking notch comprises a second slope to match with the first slope on the locking component.

6. The connected speaker device of claim 5, wherein the locking component comprises a lever arranged in a diametrical direction, and the second plate comprises an opening to receive the lever.

7. The connected speaker device of claim 6, wherein a cylindrical pin is slidably connected to the first plate, a blind hole for the cylindrical pin to slide within is arranged on the first plate, a compressed spring is arranged between the cylindrical pin and the blind hole, a second aperture is arranged on the locking component, and the cylindrical pin and the second aperture are in close contact with each other.

8. The connected speaker device of claim 7, wherein each of the first plate and the second plate has a thickness of 7 millimeters.

* * * * *